United States Patent [19]

Khimenko et al.

[11] 4,169,364

[45] Oct. 2, 1979

[54] APPARATUS FOR MAGNETIC FORMING OF METALS

[75] Inventors: Lev T. Khimenko; Yakov M. Batkilin; Anatoly V. Legeza, all of Kharkov; Mikhail I. Puchkov, Kazan, all of U.S.S.R.

[73] Assignee: Kharkovsky Politekhnichesky Institut, Kharkov, U.S.S.R.

[21] Appl. No.: 913,335

[22] Filed: Jun. 7, 1978

[51] Int. Cl.[2] ..... B21D 26/02

[52] U.S. Cl. ..... 72/56; 29/421 M

[58] Field of Search ..... 72/56, 706; 336/84 R, 336/84 M; 29/421 M

[56] References Cited

U.S. PATENT DOCUMENTS

| | | | |
|---|---|---|---|
| 3,114,585 | 12/1963 | Brower et al. | 339/14 |
| 3,282,077 | 11/1966 | Brower et al. | 72/56 |
| 3,365,923 | 1/1968 | Schenl | 72/56 |
| 3,438,230 | 4/1969 | Dietz et al. | 72/56 |
| 3,528,092 | 9/1970 | Barkhoudanar | 228/3 |
| 3,581,540 | 10/1971 | Wilde | 72/56 |

FOREIGN PATENT DOCUMENTS

| | | | |
|---|---|---|---|
| 1257728 | 1/1968 | Fed. Rep. of Germany | 72/56 |
| 1279619 | 10/1968 | Fed. Rep. of Germany | 72/56 |

*Primary Examiner*—Leon Gilden
*Attorney, Agent, or Firm*—Fleit & Jacobson

[57] ABSTRACT

An apparatus for metal forming under the pressure of pulsed magnet field comprises coils which are connected in series by means of flat buses, the extreme coils being provided with flat outputs arranged in parallel to one another along the coils; the flat buses are disposed intermediate the flat outputs and are insulated therefrom, with each of said flat buses being formed with a slot facing the coils and overlapped by the flat outputs. Such apparatus construction permits its efficiency to be increased 25 to 40 percent.

1 Claim, 2 Drawing Figures

APPARATUS FOR MAGNETIC FORMING OF METALS

BACKGROUND OF THE INVENTION

1 Field of the Application

The present invention relates to metal forming apparatus, and more particularly to an apparatus for forming of metals under the action of pulsed magnetic field.

The invention is applicable for the forming of tubular and flat metal workpieces by means of pulsed magnet power in such operations as drafting, flattening and flat forging.

2. Description of the Prior Art

There is known an apparatus for metal forming under the pressure of pulsed magnet field (cf. FRG Patent N 1,257,728 cl.7c 26/14, 1968), which apparatus comprises series-connected coils, of which the extreme coils are fitted with flat outputs. The interconnection of the adjacent coils is effected by means of special dovetail attachment. The outputs of the extreme coils of the apparatus are made in the form of flat buses.

In the known apparatus, electric current is applied to the extreme coils and electromagnetic fluxes arising from said currents are not in equilibrium. This leads to higher induction of outputs, especially in the apparatus having a limited number of rings, for example, two or three rings. In this case the induction of outputs is commensurate with the induction of the "coils - workpiece" system, which drastically decreases the apparatus efficiency. Power losses are considerable, ranging from 25 to 40 per cent.

SUMMARY OF THE INVENTION

It is therefore an object of the invention to provide an apparatus for forming of metals under the pressure of pulsed magnetic field, which will feature high efficiency.

The invention provides an apparatus for working metals under pressure of pulsed magnet field, comprising coils interconnected in series, the extreme coils being provided with flat outputs, wherein, according to the invention, the flat outputs are spaced in parallel arrangement relative to one another, with the adjacent coils being connected by means of flat buses disposed intermediate the flat outputs and insulated therefrom, each of said flat buses being formed with a slot facing the coil and overlapped by the flat outputs.

Such constructional arrangement of the apparatus for forming metals under the pressure of pulsed magnet field permits its efficiency to be enhanced to 25 to 40 percent.

BRIEF DESCRIPTION OF THE DRAWINGS

The invention will be further described, by way of example only, with reference to the accompanying drawings, wherein.

DESCRIPTION OF THE PREFERRED EMBODIMENT

Figure 1:
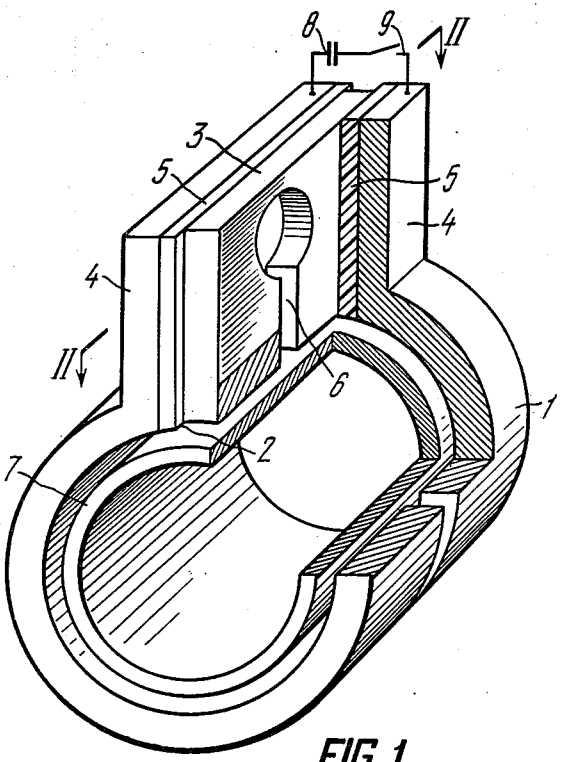
FIG. 1 is a general isometric view of an apparatus for metal forming under the pressure of pulsated magnet field, according to the invention.

In the preferred embodiment, an apparatus for metal forming under the pressure of pulsated magnet field comprises massive metal coils 1 (FIG. 1). The coils 1 may vary in number, which is selected in accordance with the length and nomenclature of the workpieces being formed. The usual number of rings used from 2 to 5. The embodiment of the invention under the consideration comprises two coils 1. There is formed a gap 2 between the ends of each coil 1.

The ends of adjacent coils 1 are connected in series in the region of the gap 2 by means of a flat bus in a manner to permit a unidirectional flow of current. The opposite ends of the coils 1 are connected with L-shaped flat outputs 4.

The flat outputs 4 are arranged along the coils 1 on both sides of the flat bus 3 and are electrically insulated from the latter by means of linings 5 from insulating materials such as polyethyleneterphthalate, polyfluoroethylene or reinforced polyamide.

The flat bus 3 is made in the form of a plate formed with a slot 6 in symmetry with the gap between the coils 1 and facing the coils 1. The slot 6 is provided to alternate the flow of current from one coil to another, which is closed along the contour of the slot 6.

There is placed in the interior of the coils 1 a workpiece 7 to be formed.

The flat outputs 4 of the apparatus of the invention are connected to a power source 8, such as a battery of capacitors, through a commutator 9.

Figure 2:
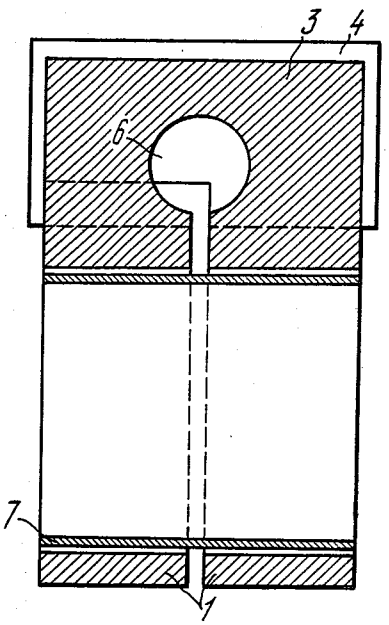
FIG. 2 is a cross-section taken along line II—II of FIG. 1.

Shown in FIG. 1 is a cross-section of FIG. 2 illustrating space relationship of the flat outputs 4 and flat buses 3 with the slot 6. In plan the slot 6 is overlapped by the plane of flat outputs 4. To increase the path of current flowing from one ring to another, the slot 6 is preferably made annular.

The apparatus according to the invention for magnetic forming of metals operates in the following manner.

First, the commutator 9 is actuated to initiate a flow of discharged current passing from the battery of capacitors 8 through the flat outputs 4, flat bus 3. In accordance with the law of electromagnetic induction e.m. f. is established in the workpiece 7 to cause the flow of circulating current.

Electrodynamic interaction between the current of the coils 1 and the workpiece 7 causes deformation of the latter.

The distribution of the current flowing over the surfaces of the flat bus 3 and of the flat outputs 4 is controlled by means of the slot 6 connecting the inner surfaces of the coils 1.

As a result of such spacial arrangement of the flat bus 3 and flat outputs 4, the current is caused to pass along the path where the distance between said flat outputs 4 and flat bus 3 is minimal, i.e. over the surfaces separated by the insulating linings 5, which makes for minimum induction of the flat outputs 4.

We claim:

1. An apparatus for forming of metals under the pressure of pulsated magnet field, comprising:

at least two coils interconnected in series, the extreme coils being fitted with flat outputs arranged in parallel to one another along said coils;

a flat bus disposed intermediate said flat outputs and adapted to connect said coils;

a slot formed in said flat bus and facing said coils; said flat outputs being arranged so that said slots become overlapped therewith;

linings formed of an insulting material, spaced intermediate said flat bus and said flat outputs, and intended for their electrical insulation.

* * * * *